United States Patent [19]

Kasper

[11] Patent Number: 5,067,317

[45] Date of Patent: Nov. 26, 1991

[54] PROCESS FOR GENERATING ELECTRICITY IN A PRESSURIZED FLUIDIZED-BED COMBUSTOR SYSTEM

[75] Inventor: Stanley Kasper, Pittsburgh, Pa.

[73] Assignee: The United States of America as represented by the United State Department of Energy, Washington, D.C.

[21] Appl. No.: 484,303

[22] Filed: Feb. 26, 1990

[51] Int. Cl.[5] ..... F02C 3/26

[52] U.S. Cl. ..... 60/39.05; 60/39.464

[58] Field of Search ..... 60/39.05, 39.464, 39.53, 60/39.55

[56] References Cited

U.S. PATENT DOCUMENTS

| | | | |
|---|---|---|---|
| 2,735,265 | 2/1956 | Eastman | 60/39.05 |
| 4,377,066 | 3/1983 | Dickinson | 60/39.05 |
| 4,453,474 | 6/1984 | Lewis | 110/188 |
| 4,495,872 | 1/1985 | Shigaki | 110/190 |
| 4,499,857 | 2/1985 | Wormser | 122/4 D |
| 4,542,621 | 9/1985 | Andersson et al. | 60/39.05 |
| 4,708,068 | 11/1987 | Hattori et al. | 110/245 |

*Primary Examiner*—Louis J. Casaregola

*Attorney, Agent, or Firm*—David E. Breeden; Stephen D. Hamel; William R. Moser

[57] ABSTRACT

A process and apparatus for generating electricity using a gas turbine as part of a pressurized fluidized-bed combustor system wherein coal is fed as a fuel in a slurry in which other constituents, including a sulfur sorbent such as limestone, are added. The coal is combusted with air in a pressurized combustion chamber wherein most of the residual sulfur in the coal is captured by the sulfur sorbent. After particulates are removed from the flue gas, the gas expands in a turbine, thereby generating electric power. The spent flue gas is cooled by heat exchange with system combustion air and/or system liquid streams, and the condensate is returned to the feed slurry.

11 Claims, 1 Drawing Sheet

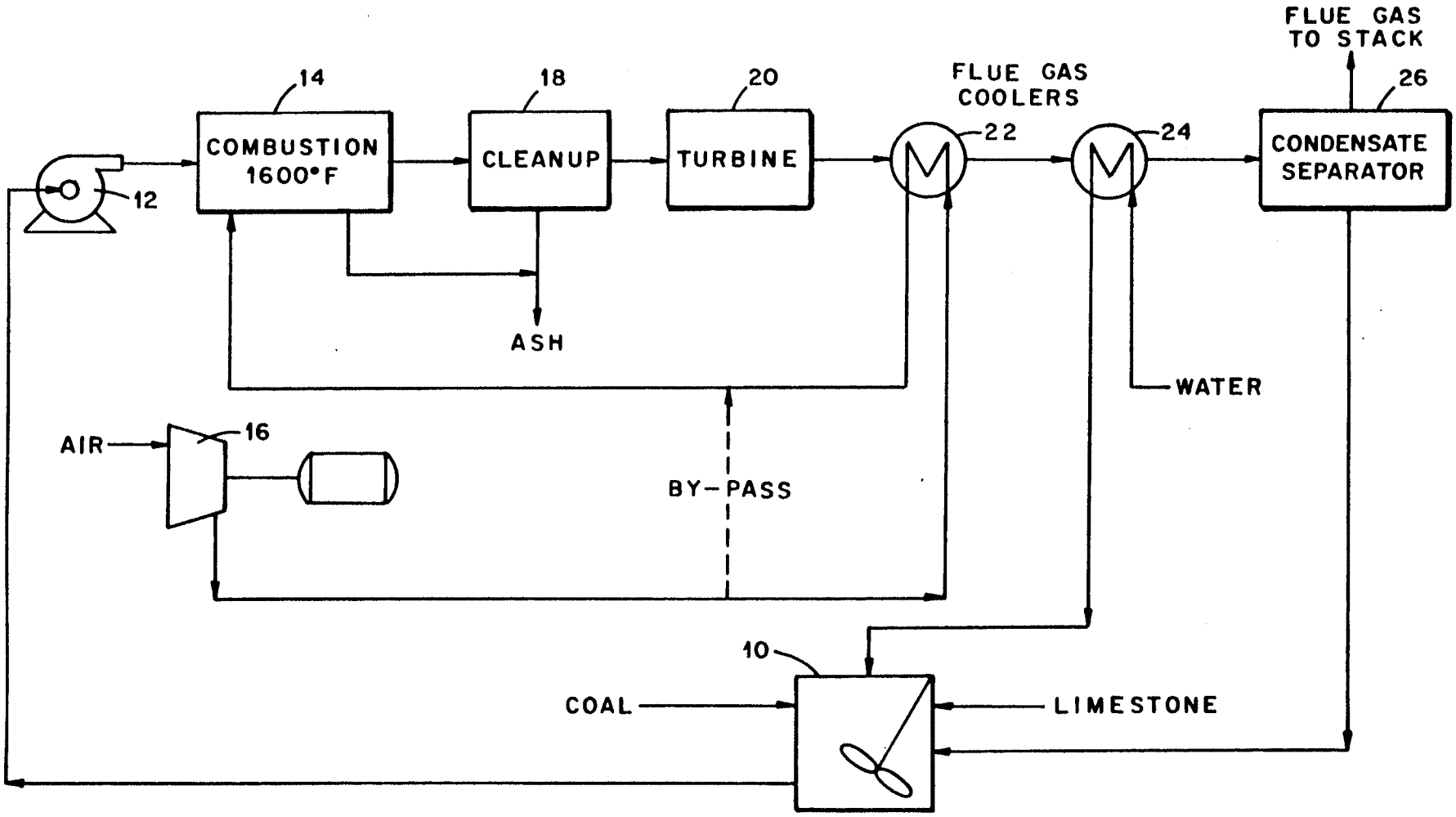
FLUE GAS TO STACK
26
CONDENSATE SEPARATOR
WATER
24
FLUE GAS COOLERS
22
LIMESTONE
20
TURBINE
BY-PASS
10
18
CLEANUP
ASH
COAL
14
COMBUSTION 1600°F
16
12
AIR

PROCESS FOR GENERATING ELECTRICITY IN A PRESSURIZED FLUIDIZED-BED COMBUSTOR SYSTEM

ASSIGNMENT OF RIGHTS

This invention has been assigned to the United States Government pursuant to the employer-employee relationship of the U. S. Department of Energy and the inventor.

FIELD OF THE INVENTION

The present invention relates to the use of coal in the generation of electricity, and more particularly, is directed to a process for generating electricity in a system which includes a pressurized fluidized-bed combustor an a gas turbine wherein temperature control is provided so as to eleminate the current practice of using internal coils for controlling temperature.

BACKGROUND OF THE INVENTION

Coal is one of the least expensive and most abundant sources of energy in the United States. The major end use of this energy source is in the conversion thereof to produce electricity. The economic conversion of coal to electricity has been the subject of a great deal of research and study. For example, coal and other combustible materials have for many years been burned in a wide assortment of furnaces, and the heat of combustion has been used to produce steam for the powering of turbogenerators. More recently, there has been substantial growth of atmospheric fluidized-bed combustors (AFBC) and entrained fuel-type combustors for this purpose. The addition of lime or limestone to the combustors has enabled simultaneous desulfurization of the flue gases produced during the combustion process. This treatment has been particularly effective in fluidized-bed combustors, often achieving more the 90 percent removal of the sulfur entering with the coal.

A further development of the AFBC is the pressurized fluidized-bed combustor (PFBC) which provides a new approach to the generation of power. In this approach, the combustor is pressurized and the hot flue gases are expanded through a gas turbine for generating electrical power. The gas turbine is a device which generates power by the expansion of gases, usually combustion product gases. The combustor producing the gases is often a integral part of the turbine, although it can be physically separated. A gas turbine with an integral coal burning combustor can be considered as providing what is essentially a one-step process for converting coal to electricity and thus represents an exceptionally simple approach to coal conversion.

In addition to the pressurized combustor, a conventional PFBC typically includes coils located in the combustor which carry water that is converted to steam. The steam can be utilized in a steam-injected gas turbine or in a separate steam turbine. In order to limit the formation of nitrogen oxides and to efficiently remove sulfur oxides, the temperature in the combustor must be maintained near 1,600° F. This has been done in current designs by heat removal through the generation of steam in the internal coils. A discussion of the background and current state of development of PFBC's for power production may be found in "Proceedings: Pressurized Fluidized-Bed Combustion Power Plants," EPRI CS-4028, May 1985.

The pressurized fluidized-bed combustor is still under development and is not considered to be fully ready for commercialization because of uncertainty as to the economics of this approach. One of the items contributing to this uncertainty is the use of internal coils referred to above in providing a means of temperature control to the pressurized fluidized-bed combustor system in that such an approach adds significantly to the costs of the system.

SUMMARY OF THE INVENTION

It is an object of the present invention to eliminate the internal coils in the PFBC by providing alternative means of temperature control, to thereby reduce system costs and, in addition, to improve power generation efficiency.

It is a further object of the invention to provide a very simple and direct way of converting coal to electric power where only one major piece of equipment is required, that being a turbo/compressor/generator unit having an offboard combustor for firing coal.

Generally speaking, the fluidized-bed combustor system of the invention generates electricity by feeding a coal slurry to a combustor and by using a gas turbine to produce electric power from the expanding gas feed thereto from the combustor. More particularly, the system comprises a feed slurry means for providing a coal slurry containing a predetermined mixture of coal and other constituents and a pressurized combustor means which receives the feed slurry and combusts the coal therein with air in a pressurized chamber, and which outputs a mixture of flue gas and particulates. After the flue gas is cleaned up, i.e., the particulates are removed from the flue gas, the latter is fed to a turbine generator means which generates electric power as the flue gas expands. Output spent flue gas is delivered to heat exchange means which cools the spent flue gas, with system combustion air and/or system water, prior to releasing the gas to the atmosphere through a stack, with condensate being returned to the feed slurry. More specifically, the cooling of the spent flue gas by the heat interchange means uses air passing through the same conduit that inputs the air to the pressurized combustor means, and/or uses water passing through the same conduit that inputs water to the feed slurry, and thus to the pressurized combustor means.

Among other advantages of the present invention, no separate steam/condensate circuit is required, no waste heat recovery unit is needed, and there is only one motor fluid, the fluid gas. The system disclosed can replace the currently envisioned PFBC configuration, with a likely improvement in higher thermal efficiency and lower capital costs, which means that the cost of producing electricity can be reduced. It is expected that the chief area of application of the invention is to electrical generation units in the size range of 50 to 200 MW. Larger installations will also be benefited in cases where a phased or modular construction is indicated. Thus, the system of the invention can be used in the majority of new generation facilities producing power from coal, and can reduce the cost of this source of energy production.

Other objects, features and advantages of the invention will be set forth in, or apparent from, the detailed description of a preferred embodiment of the invention which follows.

BRIEF DESCRIPTION OF THE DRAWING

The single figure of the drawings is a schematic block diagram of a pressurized fluid-bed combustor system according to the present invention.

DETAILED DESCRIPTION OF THE PREFERRED EMBODIMENTS

Refer to the drawing, which illustrates a preferred embodiment of the pressurized fluidized-bed combustor system of the invention. The system includes a feed tank 10 into which, as illustrated, coal, water and sulfur sorbent, such as limestone, are fed along with any other desired constituents such as, for example, stabilizers. Feed tank 10 feeds a slurry of these constituents to a pump 12 for pumping to a combustor 14. The maximum solids content of the slurry is about 70 percent by weight and is limited by pumpability. The solids concentration can be much lower if desired. Combustion air provided to combustor 14 by compressor 16 which can be part of a turbocompressor set. The minimum amount of air required corresponds to the theoretical amount required for complete combustion. As the excess air is increased, the flame temperature is reduced. Thus, the operating temperature of combustor 14 can be controlled by varying excess air. Likewise, as the percent of solids in the slurry feed is reduced, the amount of water supplied in the slurry to combustor 14 is correspondingly increased and the flame temperature is reduced. The combustor temperature can thus be controlled by varying the amount of air or water added. Practical considerations prevent the use of only one stream as a control, and both streams are to be used together to achieve an optimum result.

The flue gas produced by combustor 14 is supplied to a gas turbine or turbogenerator 20 through a cleanup unit 18. The flue gas is suitably cleaned by cleanup unit 18 so as to remove sulfur and particulates and thus meet environmental requirements and/or to prevent damage to the turbine or turbogenerator 20, and is expanded to near atmospheric pressure in the gas turbogenerator 20. The amount and type of gas cleanup provided forms no part of the invention and conventional cleanup techniques can be employed. The pressure drop must be such as to produce a low temperature in the spent gas. Turbine 20 is connected, through a first flue gas cooler 22 to which air from compressor 16 is supplied and a second flue gas cooler 24 to which water is supplied, to a condensate separator 26. The spent flue gas is exhausted as illustrated while the condensed product is returned to the feed tank 10. The additional heat exchange with entering air in flue gas cooler 22 or water in flue gas cooler 24 will reduce the temperature of the flue gas to a minimum before the flue gas is discarded.

For a fixed coal rate, it is therefore desirable to minimize the flue gas quantity and temperature if the system is energy self-sufficient. The selection of combustor pressure level, excess air, and slurry concentration must provide for minimum enthalpy loss while maintaining a temperature of about 1,600° F. in combustor 14.

It is intended by the appended claims to cover the many features and advantages of the system which fall within the true spirit and scope of the invention. Since numerous modifications and changes will readily occur to those skilled in the art, it is not desired to limit the invention to the exact construction and operation illustrated and described, and accordingly, all suitable modifications and equivalents may be resorted to as falling within the scope of the invention.

What is claimed is:

1. A method of generating electric power from coal using a pressurized fluidized-bed combustor system, the method comprising the steps of:

(a) supplying coal in a feed slurry comprising water, coal and a sulfur sorbent to a combustor;

(b) combusting the coal with air in a pressurized combustor chamber in the combustor to produce a flue gas;

(c) controlling the combustor temperature by varying an amount of excess air and water supplied to the combustor, whereby increasing the excess air and water reduces the combustor operating temperature;

(d) allowing the flue gas to expand through a turbine to generate electric power, and (e) cooling the flue gas, after exiting from the turbine, by heat exchange with a system fluid whereafter spent gas is outputted at the atmosphere and liquid condensed from the flue gas is returned to the feed slurry.

2. A method as claimed in claim 1 further comprising extracting substantially all of any sulfur and particulates from the flue gas produced in the combustor chamber.

3. A method of generating electric power from coal according to claim 1, wherein the cooling of the flue gas is carried out by heat exchange with both combustion air and system liquid streams.

4. A method of generating electric power from coal according to claim 3, wherein the combustion temperature in the combustor is maintained at approximately 1,600° F.

5. A method of generating electric power from coal according to claim 2, where the sulfur sorbent added is limestone.

6. A method of generating electric power from coal according to claim 1, where solids, including stabilizer chemicals, coal fuel, and a sulfur sorbent are added to the feed slurry to produce a feed slurry content consisting of a predetermined percentage of solids.

7. A method of generating electric power from coal according to claim 1, wherein air is supplied to the combustor using a compressor.

8. A method of generating eletric power from coal according to claim 1, further comprising the step of varying an amount of water supplied to the combustor to vary the percentage of solids in the slurry feed so that as the percentage of solids is reduced, the combustor operating temperature is reduced.

9. A method of generating electric power from coal according to claim 1, further comprising the step of expanding the flue gas to near atmospheric pressure so as to lower the temperature of the flue gas.

10. A method of generating electric power from coal according to claim 1, wherein combustion of the coal is carried out at a predetermined pressure, with a predetermined amount of excess air, and with a predetermined slurry concentration, so as to maintaining a temperature of approximately 1,600° F. in said combustor.

11. A method of generating electric power from coal according to claim 1, wherein electric power is generated using said flue gas as the only motive fluid in a single piece of equipment comprising a turbo/compressor/generator set, and wherein said combustor comprises an offboard combustor.

* * * * *